United States Patent [19]

Miller

[11] 3,949,681

[45] Apr. 13, 1976

[54] MOTOR ACTUATED RAILWAY HOPPER CAR DOOR MECHANISM

[75] Inventor: Roy W. Miller, Highland, Ind.

[73] Assignee: Pullman Incorporated, Chicago, Ill.

[22] Filed: Apr. 25, 1975

[21] Appl. No.: 571,831

[52] U.S. Cl. ..... 105/284; 105/240; 105/250; 105/290; 105/304

[51] Int. Cl.[2] ... B61D 7/04; B61D 7/06; B61D 7/18; B61D 7/28

[58] Field of Search ..... 105/240, 250, 251, 253, 105/284, 290, 291, 304, 424; 298/36

[56] References Cited

UNITED STATES PATENTS

| | | | |
|---|---|---|---|
| 693,132 | 2/1902 | Heiden | 105/250 |
| 731,817 | 6/1903 | Russell | 105/291 |
| 938,976 | 11/1909 | Clark | 105/250 |
| 1,908,096 | 5/1933 | Yost | 105/424 |
| 2,723,878 | 11/1955 | Rockwell | 298/36 |
| 3,339,500 | 9/1967 | Dorey | 105/253 |
| 3,455,253 | 7/1969 | Floehr | 105/251 |
| 3,717,109 | 2/1973 | Miller | 105/284 |
| 3,717,110 | 2/1973 | Miller | 105/284 |

*Primary Examiner*—Albert J. Makay
*Assistant Examiner*—Howard Beltran
*Attorney, Agent, or Firm*—Richard J. Myers

[57] ABSTRACT

A fluid motor actuating mechanism for railway hopper car doors includes a linkage arrangement which interconnects the doors to provide for opening and closing operation in concert. The doors are supported adjacent a discharge opening and are arranged to swing outwardly to maximum degree to provide an enlarged space through which material is discharged from the hopper car.

7 Claims, 5 Drawing Figures

MOTOR ACTUATED RAILWAY HOPPER CAR DOOR MECHANISM

BACKGROUND OF THE INVENTION

1. Field of the Invention

The invention herein disclosed pertains to bottom dump railway hopper cars having opening and closing mechanisms wherein the doors are swingable downwardly and outwardly relative to the discharge opening of the car.

2. Description of the Prior Art

The prior art relating to bottom dump arrangements for hopper cars is disclosed in U.S. Pat. Nos. 3,717,109 and 3,717,110, patented Feb. 20, 1973.

The present invention is an improvement over the aforementioned prior art. A simplified arrangement of the linkages and hanger construction permits the doors to be opened outwardly to a maximum degree thereby affording a relatively large discharge opening for the discharge of material contained within the hopper.

Summary of the Invention

The present invention relates to an improvement in an operating mechanism and door arrangement for a sill-less type of hopper car. In the present invention the doors are supported on their outer ends by linkages which in turn are supported below the side slope sheets of the hopper. As the doors are moved to an open position, the linkages form a jackknife position relative to the doors so that the doors may be opened to a maximum degree providing a large discharge opening. An actuating arm and linkage arrangement pivots a bell crank lever which in turn is connected to a push-pull rod which is pivotally connected to a second door providing for in-concert operation of the doors during opening and closing movements. Single hanger arms are pivotally connected at the center of the doors, the hanger arms being pivotally connected to a portion of the hopper so that the doors may be swung to a wide open position. By virtue of the unique jackknife movement of the links and doors, the doors may be not only opened to a wide arrangement but also are positioned substantially above the track so as to prevent any undue interference during operation.

DESCRIPTION OF THE PREFERRED EMBODIMENT

Figure 1:
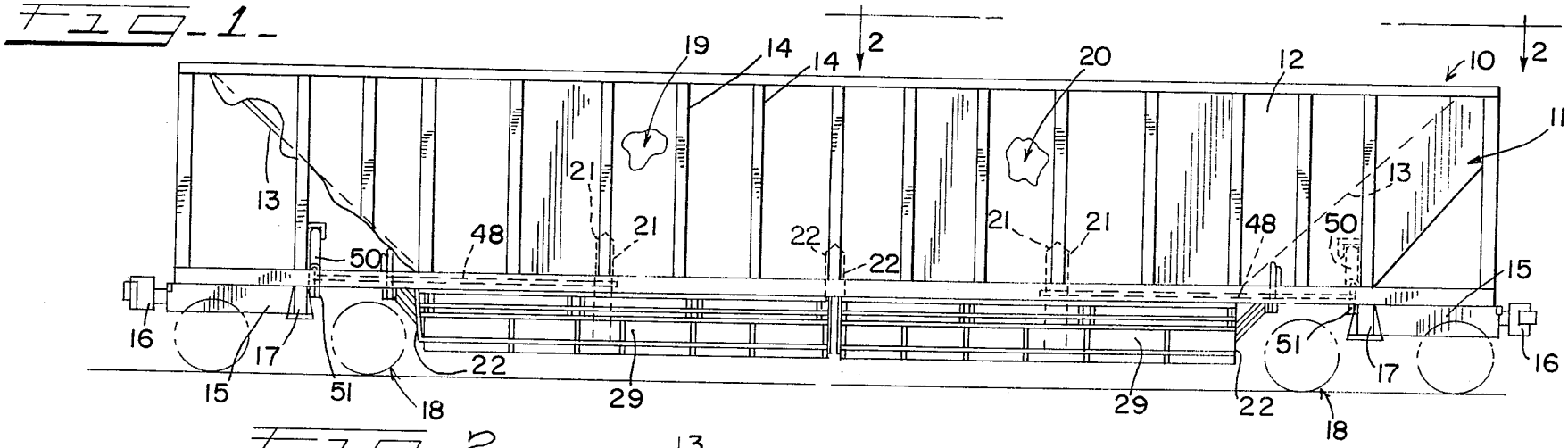
FIG. 1 is a side elevational view of a hopper car including an improved bottom discharge arrangement.
Figure 2:
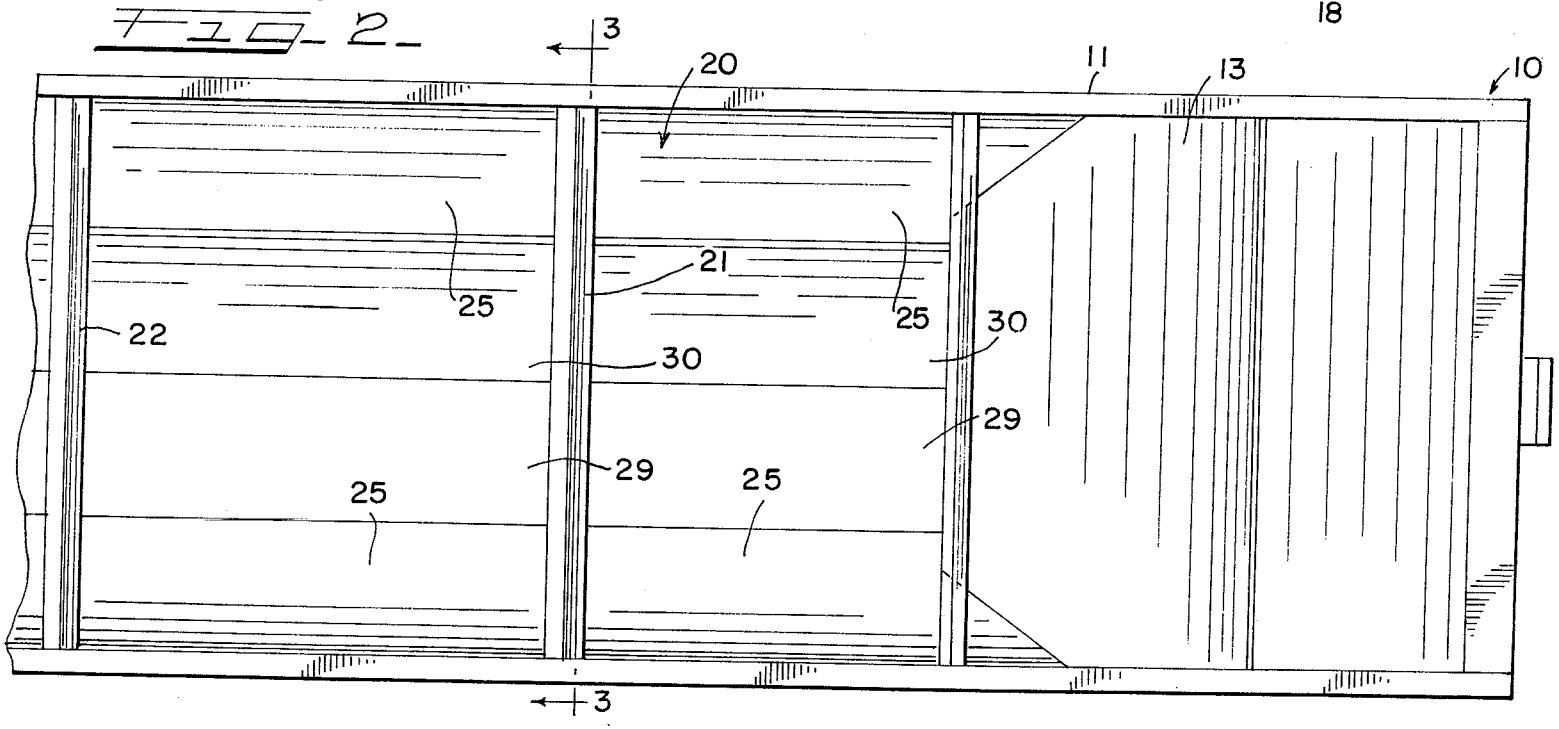
FIG. 2 is a plan view taken substantially along the line 2—2 of FIG. 1.
Figure 3:
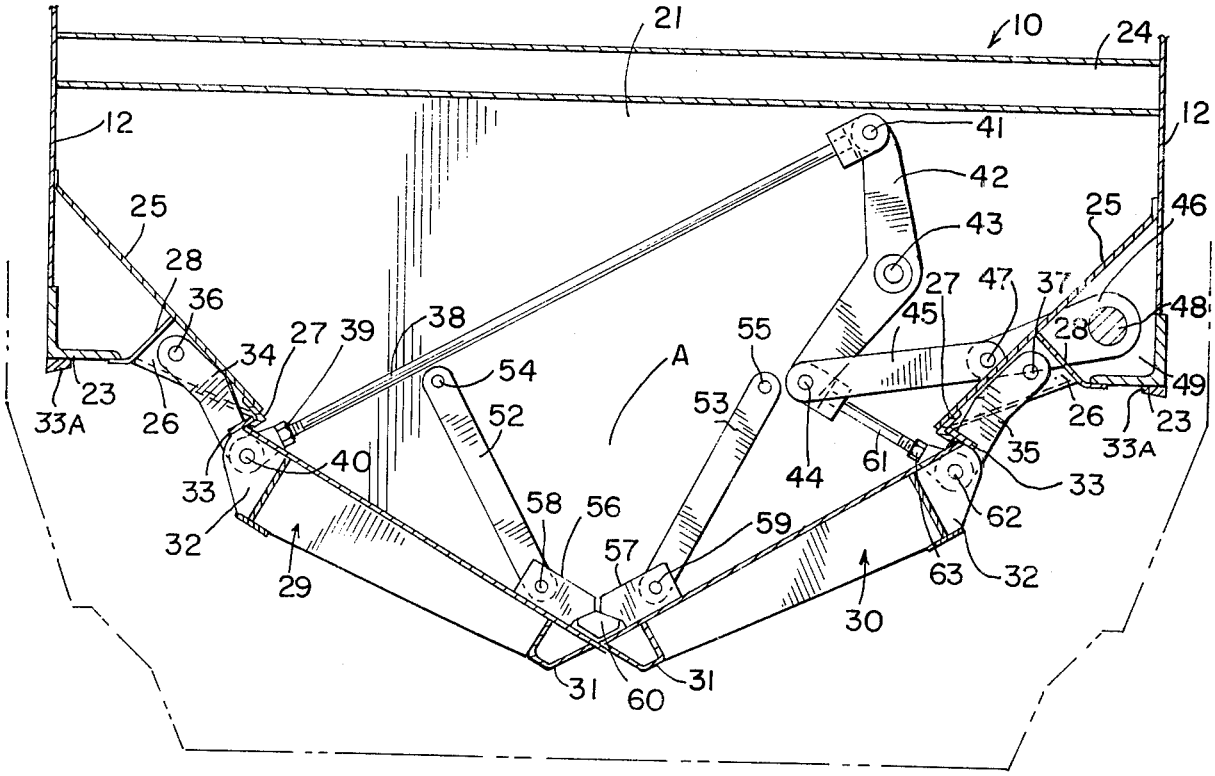
FIG. 3 is a cross sectional view of hopper doors in a closed position, showing certain parts in elevation, and taken substantially along the line 3—3 of FIG. 2.
Figure 4:
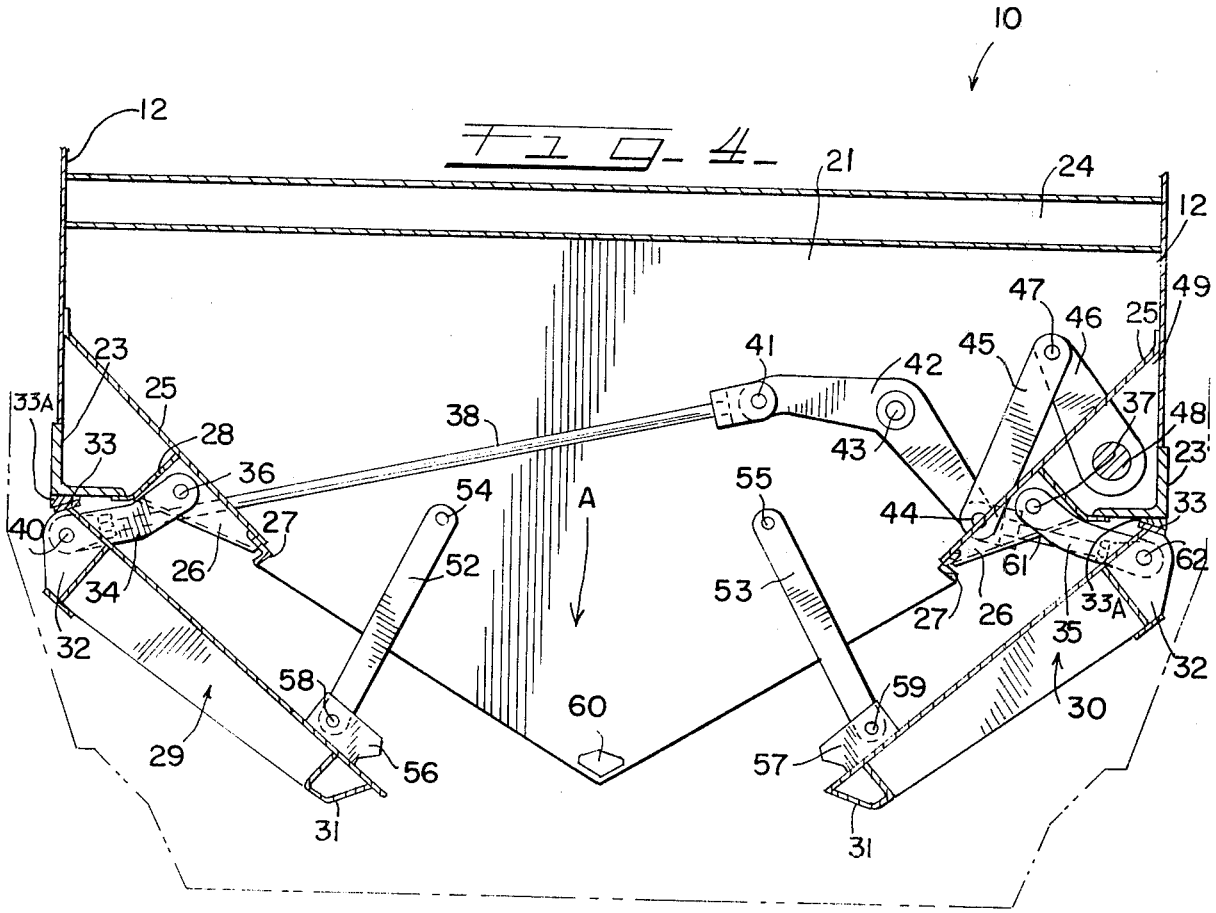
FIG. 4 is a view similar to FIG. 3 showing an operating position of railway car doors.

Referring particularly to FIG. 1, an open top railway hopper car 10 includes a body 11 having side walls 12. Connected to opposite ends of the side walls 12, are ends walls 13 which slope downwardly and inwardly toward the center of the car. The side walls 12 are also provided with the usual type of vertical side posts 14. The present railway car 10 is of the sill-less type including stub center sills 15 provided at opposite ends of the car and which also include conventional couplers 16. The body 10 also includes body bolsters 17 which are adapted to be supported on conventional wheel trucks 18 generally designated. The present open top railway hopper car 10 is provided with hoppers 19 and 20 each of which includes hopper divider walls 21 and central and end divider walls 22, as best shown in FIG. 2. The body 11 also includes the conventional longitudinally extending laterally spaced side sills 23. Transversely extending upper supports 24 are also provided along longitudinal portions of the hopper car 10. As best shown in FIGS. 2, 3 and 4, each of the hoppers 19 and 20 also include inwardly sloping sheets 25 terminating in a discharge opening designated at A.

Figure 5:
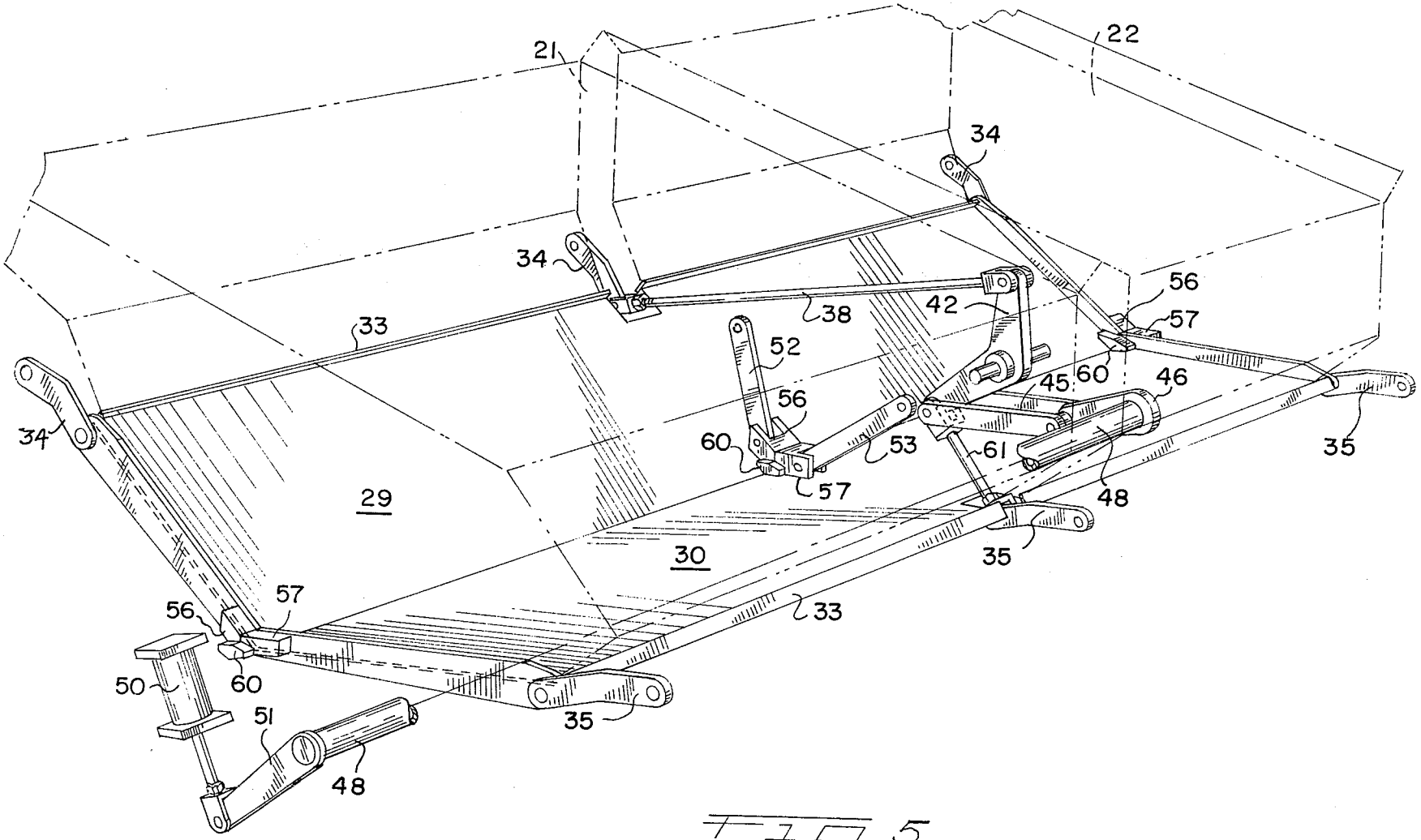
FIG. 5 is a perspective view of the bottom discharge arrangement.

A pair of doors 29 and 30 are provided for each of the two hoppers disclosed in FIG. 1. The constructions shown in FIGS. 3 and 4, including the linkage arrangement for opening and closing the doors, is provided at the center of each of the doors, it being understood that the arrangement is contained within a hood consisting of walls 21 as shown in FIGS. 3, 4 and 5. As shown in FIGS. 1 and 5, divider walls 22 are provided at the center of the car between adjacent ends of the doors 29 and 30. Beneath slope sheets 25 there are provided brackets 26 which have connected thereto at their ends flange angle brackets 27 extending longitudinally the length of the door openings A. A diagonal wall portion 28 is connected to the underneath surface of the slope sheets 25 and also is suitably connected to the side sills 23 as indicated in FIGS. 3 and 4. A leading edge or inner door portion 31 is provided for the doors 29 and 30. Each of the doors also are provided with an outer bracket portion 32 which has connected thereto a longitudinal flanged member 33. A door stop 33-A is secured to the side sills 23. The door 29 has its outer door bracket portion 32 connected to first pivot link 34. A similar pivot link 35 is suitably connected to the outer door bracket portion 32 of the door 30. Pivot pins 36 and 37 respectively connect the links 34 and 35 to the brackets 26. The pivot links 34 and 35 are provided at opposite ends of the said doors 29 and 30.

An adjustable push and pull or thrust link is designated at 38, the same including adjustable connector means 39 whereby the length of the link may be changed in conventional fashion. The push and pull link 38 is connected by a common pivot pin 40 to the link 34 and outer door bracket portion 32. The thrust link 38 is pivotally connected as indicated at 41 to a bell crank lever 42 pivotally connected as indicated at 43 to the divider wall 21. The lower end of the bell crank lever 42 is pivotally connected by means of a pivot pin 44 to a link 45 in turn connected to an actuating arm 46 by means of a pivot pin 47. The actuating arm 46 is rigidly and pivotally supported for rotating movement to a shaft 48 which as best shown in FIG. 1 extends longitudinally from each of the lever mechanisms toward the end of the car and is suitably supported on brackets 49 in turn mounted on one of the side sill structures 23. An air cylinder 50 is suitably supported at each end of the railway car, as shown in FIG. 1, the same including piston rod and lever arrangement 51 in turn connected to the shaft 48 for rotating the same in response to conventional operation of the air cylinder 50. The doors 29 and 30 are also respectively connected at their inner door portions 31 to hanger arms 52 and 53. The hanger arms 52 and 53 are suspended from pivots 54 and 55 respectively provided on the divider walls 21. The hanger arms 52 and 53 in the closed position of the doors shown in FIG. 3 converge downwardly and are pivotally connected by means of pivot pins 58 and 59 to pivot brackets 56 and 57 supported on the doors 29 and 30. In the closed position as shown in FIG. 3, the inner door portion 31 engages stops 60 extending between and supported on the walls 21 and 22. The brackets 56 and 57 are also suitably shaped to support the inner and outer ends as well as the center of the doors on the stops 60.

As best shown in FIG. 3, an adjustable link 61 is suitably connected to the common pivot 44 with the link 45 and bell crank lever 42. The link 61 is of the adjustable type providing for lengthwise adjustment by means of adjustable connector means 63, the link 61 also being pivotally connected at a common pivot point indicated at 62 which connects the right hand outer door bracket portions 32 (FIGS. 3 and 4) to the link 35.

The Operation

In the closed position of the doors shown in FIG. 3, the inner and outer ends as well as the center of the doors are suitably supported on the stops 60 and the linkage arrangement and actuating arms 46 are in the locked or closed position. When the hopper car reaches its ultimate point of destination and the load therein is to be dumped, the air cylinders 50 are actuated to rotate the shafts 48 whereupon the arms 46 positioned at center of each of the doors are in turn rotated to thereby start the actuation of the linkage mechanism shown in FIGS. 3 and 4. Movement of the bell crank levers 42 in response to movement of the arms 46 and links 45 provides for the movement of the thrust links 38 from the position shown in FIG. 3 to the position shown in FIG. 4 which in turn actuates to pivot the links 34 outwardly whereupon the door 29 is moved to an open position. Similarly, the links 61 which are moved in response to pivotal movement of the bell crank levers 42 pushes the doors 30 outwardly with the hangers 52 and 53 guiding the outward and downward movement of the doors. Since the links 34 and 35 swing outwardly to the position shown in FIG. 4 and upwardly underneath the slope sheets 25, the outer ends of the doors are moved upwardly underneath the slope sheets and a substantially wide opening is provided. As shown in FIG. 4, the movement is limited when the longitudinal flange member 33 contacts the door stop 33A. The hangers 52 and 53 are effective to maintain the inner ends 31 of the door at a relatively constant height so that the doors are in no danger of being lowered beyond the desired degree indicated so that there is little chance for interference with the track or any related obstructions that may be found in the right of way. Thus, it is clear that the arrangement provides for a maximum opening of the door so that the material can be dumped by gravity. The present doors are of the gravity type and upon release of the linkage mechanism or movement thereof, gravity also is effective to urge the doors to the open position which is provided by the load as it is being discharged, as shown in FIG. 3, in the closed position of the doors 29 and 30. The flange members 33 are nested within the angle members 27 in an effective sealing relation.

What is claimed is:

1. A bottom discharge arrangement for discharging a load from a vehicle having a hopper structure including horizontally spaced longitudinally extending frame members, downwardly and inwardly extending slope sheets supported on said frame members having lower end portions terminating in laterally spaced relation to provide a discharge opening, the improvement comprising:

first and second doors positioned to close said opening and arranged to swing relatively downwardly and laterally outwardly to an open position, first and second links respectively pivotally connected to bracket means disposed below said slope sheets, means pivotally connecting outer end portions of said first end second doors to said first and second links, an actuating lever pivotally supported on one of said frame members, a third link pivotally connected to said actuating lever and projecting inwardly over said second door, a bell crank lever pivotally supported on said hopper, a fourth link pivotally connected to said bell crank lever and to an outer end portion of said second door, means pivotally connecting said third link relative to said bell crank lever and said fourth link, thrust connector means pivotally connected to said bell crank and said first door, first and second hanger arms pivotally supported on said hopper and having lower portions thereof respectively pivotally connected adjacent to inner portions of said first and second doors, whereupon pivotal movement of said bell crank in response to actuation by said actuating lever provides for opening movement of said doors whereupon said outer portions of said door are moved outwardly underneath said slope sheets.

2. The invention in accordance with claim 1, said means pivotally connecting said third and fourth link providing single points of connection with respect to said outer portions of said doors.

3. The invention in accordance with claim 2, said fourth link including means adjusting the length thereof.

4. The invention in accordance with claim 1, said hanger arms providing the sole support for the inner portions of said doors.

5. The invention in accordance with claim 4, said hanger arms in the closed position of said doors being in a position converging in inclined manner inwardly toward said inner portions of said doors.

6. The invention in accordance with claim 1, said thrust connector means comprising a fifth link connected to an upper end of said bell crank, and being connected to said point of connection of said first link to said outer portions of said first door.

7. The invention in accordance with claim 1, said slope sheets having terminal portions provided with longitudinally extending flanges projecting outwardly laterally with respect to said slope sheets, and longitudinal flange portions on said outer ends of said doors engaging said longitudinal flanges in sealing relation during the closed position of said doors.

* * * * *